US012644680B2

(12) United States Patent
Björkgren et al.

(10) Patent No.: US 12,644,680 B2
(45) Date of Patent: Jun. 2, 2026

(54) SHAPED CHARGE ASSEMBLY

(71) Applicant: SAAB AB, Linköping (SE)

(72) Inventors: Victor Björkgren, Karlskoga (SE); Johan Östlund, Örebro (SE); Patrik Lindgren, Ôrebro (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 18/877,854

(22) PCT Filed: Jun. 20, 2023

(86) PCT No.: PCT/SE2023/050630

§ 371 (c)(1),
(2) Date: Dec. 20, 2024

(87) PCT Pub. No.: WO2023/249544

PCT Pub. Date: Dec. 28, 2023

(65) Prior Publication Data

US 2026/0002762 A1 Jan. 1, 2026

(30) Foreign Application Priority Data

Jun. 21, 2022 (SE) ..... 2200072-3

(51) Int. Cl.
*F42B 1/028* (2006.01)
*F42B 1/032* (2006.01)

(52) U.S. Cl.
CPC ..... *F42B 1/028* (2013.01); *F42B 1/032* (2013.01)

(58) Field of Classification Search
CPC .. F42B 1/02; F42B 1/028; F42B 1/032; F42B 3/08; F42B 12/10; E21B 43/117
USPC ..... 102/306–310, 476
See application file for complete search history.

(56) References Cited

U.S. PATENT DOCUMENTS 3,732,816 A * 5/1973 Muller ..... F42B 1/028 102/306
5,320,044 A 6/1994 Walters
5,522,319 A 6/1996 Haselman, Jr.
6,021,714 A 2/2000 Grove et al.
6,840,178 B2 * 1/2005 Collins ..... F42B 1/028 102/307
9,470,483 B1 * 10/2016 Wang ..... F42B 1/028
(Continued)

FOREIGN PATENT DOCUMENTS

WO 0106200 A2 1/2001

OTHER PUBLICATIONS

International Search Report and Written Opinion mailed Sep. 21, 2023 for International Application No. PCT/SE2023/050630, 15 pages.

*Primary Examiner* — James S Bergin
(74) *Attorney, Agent, or Firm* — Sage Patent Group

(57) ABSTRACT

The disclosure relates to a shaped charge assembly including a casing and a liner, the liner being a hollow dome forming a hollow space, coaxially arranged around a longitudinal central axis (x) of the shaped charge assembly. The casing and the liner together defines a volume including an explosive. The liner includes an internal surface facing the hollow space and an external surface facing the volume including the explosive. A tangent of the internal surface and a base plane (y) formed at a base end of the liner, the base plane being perpendicular to the longitudinal central axis (x), forms an angle (α) of at least 100°.

19 Claims, 2 Drawing Sheets

(56) References Cited

U.S. PATENT DOCUMENTS

| | | | | |
|---|---|---|---|---|
| 11,378,363 | B2 * | 7/2022 | McNelis | F42B 1/028 |
| 11,965,719 | B2 * | 4/2024 | Hoelscher | F42B 1/032 |
| 12,072,170 | B2 * | 8/2024 | Björkgren | F42B 1/028 |
| 2004/0200377 | A1 | 10/2004 | Collins et al. | |

* cited by examiner

SHAPED CHARGE ASSEMBLY

CROSS-REFERENCE TO RELATED APPLICATIONS

This application is a 35 U.S.C § 371 national stage application for International Application No. PCT/SE2023/050630, entitled "Shaped Charge Assembly", filed on Jun. 20, 2023, which claims priority to Swedish Patent Application No. 2200072-3, filed on Jun. 21, 2022, the disclosures and contents of which are hereby incorporated by reference in their entireties.

TECHNICAL FIELD

The present disclosure is related to a shaped charge assembly.

BACKGROUND ART

Shaped charge assemblies are widely used for penetrating hard targets, such as armor, and for providing perforations in wells and in oil and gas industry.

Shaped charge assemblies are typically designed to have good penetration into armor while not having an equivalent penetration into other types of targets, such as fortification targets. For example, it is difficult to provide a penetration hole being larger than a caliber in fortification targets such as triple brick walls and adobe walls. In order to penetrate these types of targets, and to create a sufficient hole size for a follow through charge usually a heavier shaped charge is needed. This is not desirable in carried systems since it adds weight to the shaped charge assembly.

There is thus need for an improved shaped charge assembly providing a hole with larger diameter than the caliber of the shaped charge assembly which has a relatively low weight and small size.

SUMMARY OF THE INVENTION

An object of the present disclosure is to provide a solution for a shaped charge wherein some of the above-identified problems are mitigated or at least alleviated.

According to a first aspect there is provided a shaped charge assembly comprising a casing and a liner. The liner being a hollow dome forming a hollow space, coaxially arranged around a longitudinal central axis of the shaped charge assembly, wherein the casing and the liner together define a volume comprising an explosive. The liner comprises an internal surface facing the hollow space, an external surface facing the volume comprising the explosive. A tangent of the internal surface and a base plane formed at a base end of the liner, the base plane being perpendicular to the longitudinal central axis, forms an angle of at least 100°.

According to some embodiments, the angle is 100°-120°, preferably 102-118°, most preferably 105-115°.

According to some embodiments, the tangent forming the angle extends along the internal surface at most ¼, ⅙ or ⅛ of a total length of the liner along the longitudinal central axis.

According to some embodiments, the internal surface comprises at least three portions facing the hollow space. The surface of each portion facing the hollow space is concave in the longitudinal direction of the shaped charge assembly, wherein each concave portion is arranged within a distance with respect to a center point of the base plane.

According to some embodiments, at least one of the concave portions has a spherical shape.

According to some embodiments, the hollow dome has a spheroidal, hemispherical or ellipsoidal shape.

According to some embodiments, one of the concave portions forms an apex portion of the internal surface.

According to some embodiments, the external surface is rotationally symmetric around the longitudinal central axis.

According to some embodiments, the internal surface is rotationally symmetric around the longitudinal central axis.

According to some embodiments, the liner comprises a metal or an alloy having a density of from 1 to 10 g/cm$^3$.

According to some embodiments, the liner comprises magnesium.

According to some embodiments, a thickness of the liner is 1.0-3.0 mm, preferably 1.5-2.5 mm, most preferably 1.8-2.3 mm at a thinnest portion of the liner.

According to some embodiments, a thickness of the liner is 8.0-5.5 mm, preferably 7.0-6.0 mm, most preferably 6.0-6.5 mm at a thickest portion of the liner.

At least some of the embodiments have the following advantages. The shaped charge assembly provides for a deep and wide penetration hole. In particular, a penetration hole being larger than the caliber of the shaped charge assembly is provided. The shaped charge assembly provides for an improved performance against fortification targets without providing a deteriorated effect against armour targets. The shaped charge assembly is particularly suitable for penetrating fortification targets such as triple brick walls and adobe walls. The shaped charge assembly provides for combating of fortification targets while having a relatively low weight and small size.

DETAILED DESCRIPTION

Figure 1:
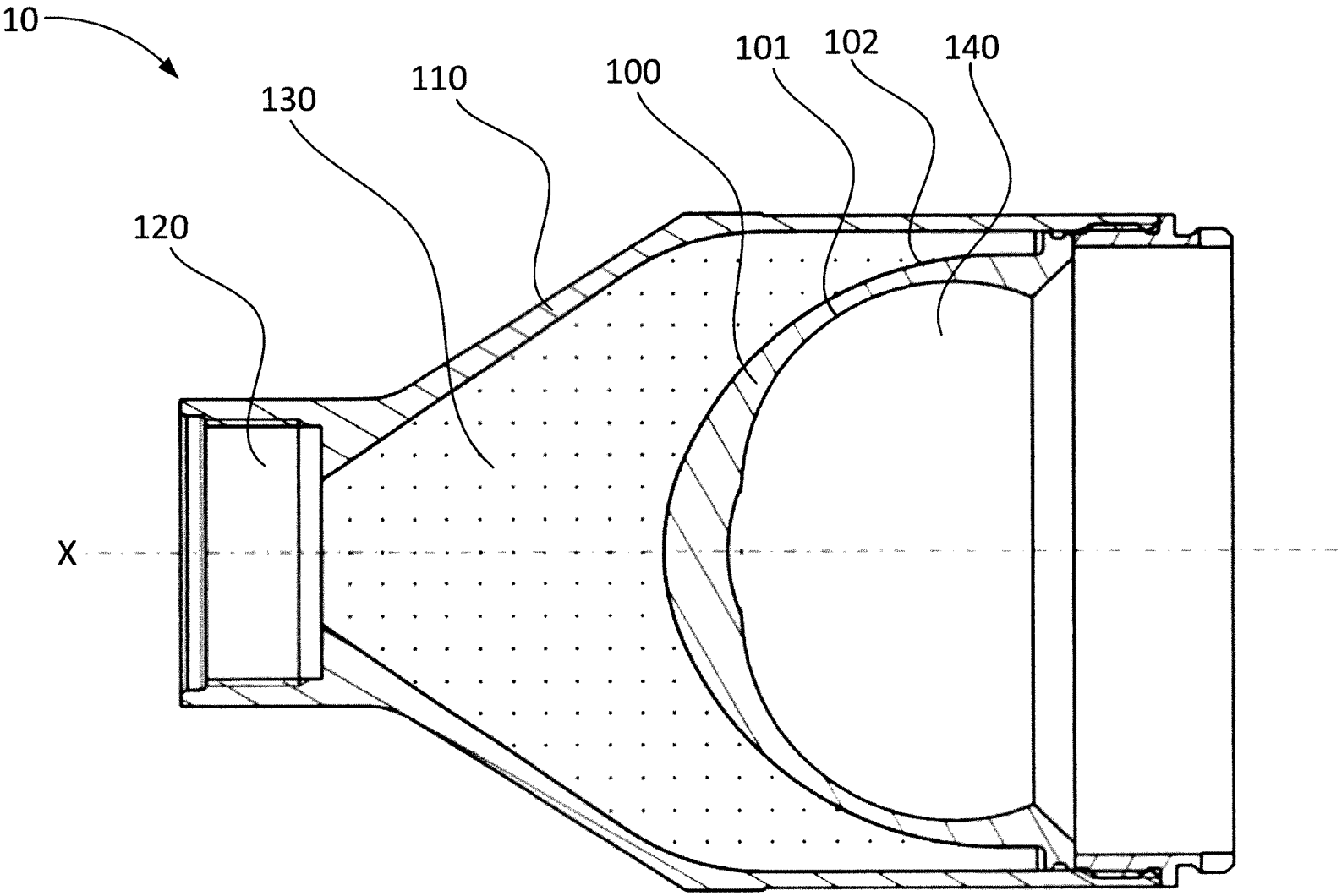
FIG. 1 schematically illustrates a shaped charge according to an example of the present disclosure.

FIG. 1 schematically illustrates a shaped charge assembly 10 according to an example of the present disclosure. The shaped charge assembly 10 comprises a casing 110 and a liner 100. The liner 100 is a hollow dome forming a hollow space, coaxially arranged around a longitudinal central axis x of the shaped charge assembly 10. The casing 110 and the liner 100 together defines a volume 130 comprising an explosive.

A shaped charge is an explosive charge shaped to focus the effect of the energy of the explosive charge. A shaped charge has both military and civil applications. Examples of military applications are shaped charges for use in missiles, torpedoes and various other types of weapons. Examples of civil applications are shaped charges used for explosive demolition of buildings and structures as well as for providing perforations in wells in oil and gas industry. A shaped charge assembly may be used on its own, i.e. to penetrate a single target. Alternatively, the shaped charge assembly may be arranged for creating a sufficient large hole for a so-called follow through charge to penetrate a second target being arranged within a first target. The shaped charge assembly of the present disclosure is typically of the latter type, i.e. being arranged for creating a hole in a first target for a follow through charge. The shaped charge assembly disclosed in the present disclosure is particularly suitable for fortification targets, such as triple brick walls and adobe walls.

The shaped charge assembly may be arranged along the central axis within a warhead, such as a missile or torpedo. The warhead may comprise one or a plurality of shaped charges assemblies being arranged along the central axis within the warhead.

Upon detonation of the explosive, a detonation front travels in an expanding spherical shock wave. As the shock wave passes through the liner, the liner collapses. Upon collapse, the liner is compressed towards the central axis x of the liner thereby forming a penetration jet and a slug of the collapsed liner. The detonation front is arranged to reach the apex of the liner first followed by the base of the liner upon collapse of the liner. As the liner material collapses towards the central axis x, some of the material is accelerated in the direction towards the base of the liner. The material travelling in this direction forms a penetration jet which stretches out due to a velocity gradient along the longitudinal central axis x. The penetration jet typically has an extremely high velocity, wherein the tip of the penetration jet travels at about 7 to 14 km/seconds and the tail of the penetration jet travels at about 1 to 3 km/seconds. The higher velocity of the penetration jet, the deeper penetration depth is obtained.

As shown in FIG. 1, the liner 100 is a hollow dome forming a hollow space 140, coaxially arranged around a longitudinal central axis x of the shaped charge assembly 10. By a hollow dome is meant that the hollow dome has a spheroidal, hemispherical or ellipsoidal shape. In one example, the hollow dome is shaped as a spheroidal cap, i.e. which means that the hollow dome is shaped as a part of a spheroid. In one example, a base plane y delimits the spherical cap, such that the spherical cap corresponds to a region of a sphere which lies above the base plane y, where the base plane y cuts the sphere below the center of the sphere, thereby making the spherical cap larger than a hemisphere.

The casing 110 and the liner 100 together defines a volume 130 comprising an explosive. As shown in FIG. 1, the liner is arranged within the casing. The casing typically comprises a material being resistant towards mechanical forces and temperature, such as a metallic material. The liner 100 comprises an internal surface 101 facing the hollow space and an external surface 102 facing the volume comprising the explosive. The hollow space 140 may comprise a gas, such as air. The shaped charge assembly 10 may further comprise an igniter 120 being arranged for activating the shaped charge assembly and an explosive 130.

Figure 2:
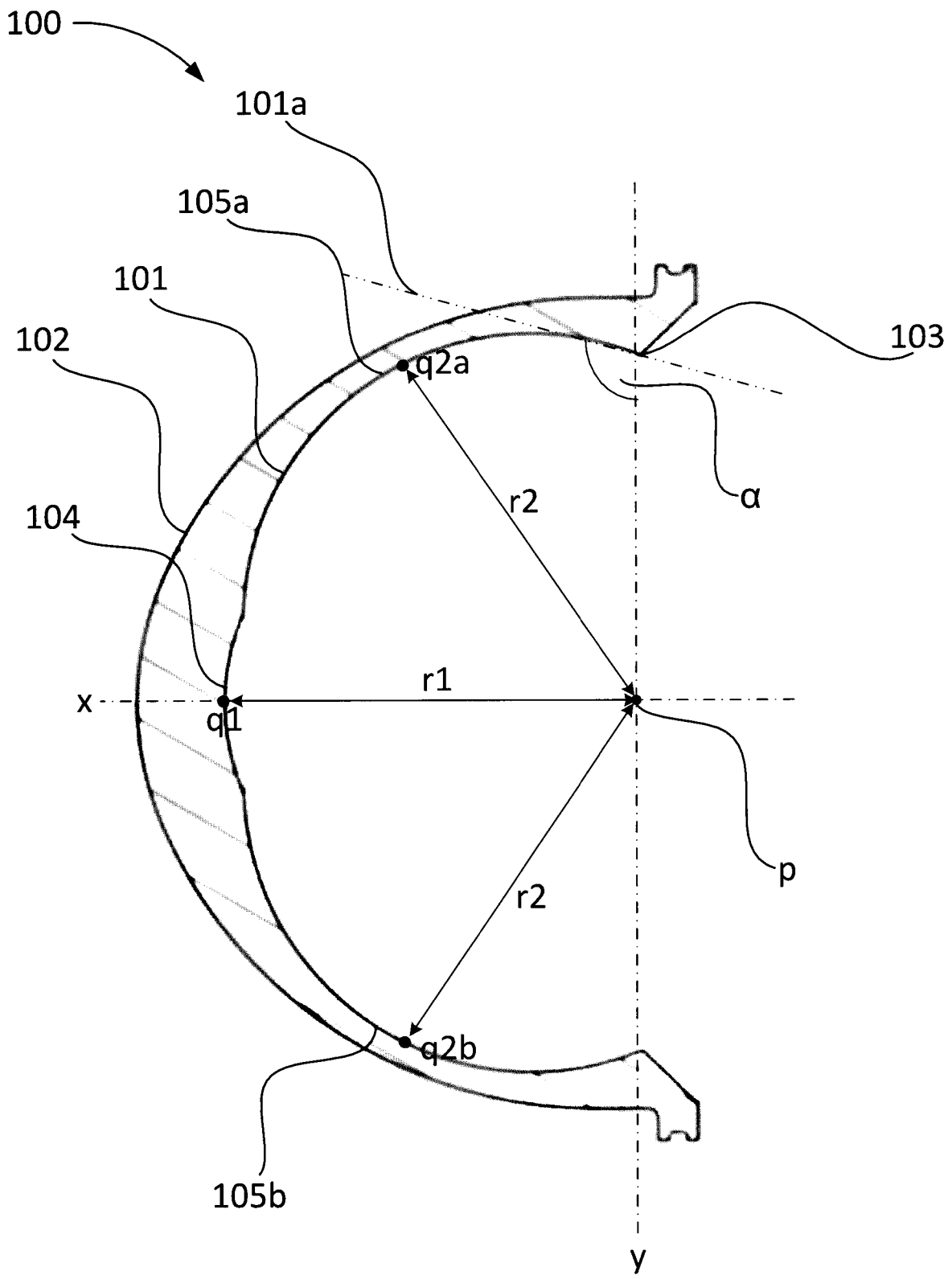
FIG. 2 schematically illustrates a liner according to an example of the present disclosure.

FIG. 2 schematically illustrates a liner according to an example of the present disclosure. As noted above, the liner 100 is a hollow dome forming a hollow space, coaxially arranged around a longitudinal central axis x of the shaped charge assembly 10.

A tangent 101*a* of the internal surface 101 and a base plane y formed at a base end 103 of the liner 100, said base plane being perpendicular to the longitudinal central axis x, forms an angle α of at least 100°. The angle α may be 100°-120°, preferably 102-118°, most preferably 105-115°. The tangent 101*a* forming the angle α may extend along the internal surface 101 at most ¼, ⅙ or ⅛ of a total length of the liner 10 along the longitudinal central axis x. Thus, the internal surface 101 of the liner 100 is slightly bent inwards towards the base plane y formed at the base end 103 of the liner 100.

The tangent 101*a* of the internal surface 101 and a base plane y formed at a base end 103 of the liner 100, said base plane being perpendicular to the longitudinal central axis x, forms an angle α of at least 100° at the inner side of the liner.

The internal surface 101 may comprise at least three portions 104, 105*a*, 105*b*, wherein the surface of each portion facing the hollow space may be concave in the longitudinal direction of the shaped charge assembly. The internal surface 101 may comprise a plurality of concave portions, such as three, four, five or six concave portions. The surface of each concave portion may comprise a point q1, q2*b*, q2*b* which is positioned at a maximal distance r1, r2 with respect to a center point p of the base plane. In one example, all concave portions have the same, i.e. equal, maximal distance r1, r2 with respect to the center point p of the base plane. In another example, all concave portions have different, i.e. non-equal, maximal distances r1, r2 with respect to the center point of the base plane. In yet an example, when the internal surface 101 comprises a plurality of concave portions, at least some of the concave portions have the same maximal distance with respect to a center point of the base plane.

In the example shown in FIG. 2, the internal surface 101 comprises three concave portions, 104, 105*a*, 105*b*, wherein one concave portion is arranged within a maximal distance r1 with respect to the center point p of the base plane and the other two concave portions are arranged within a distance r2 with respect to a center point p of the base plane. As shown in FIG. 2, one of the concave portions 104 may be arranged centred with respect to the longitudinal axis x, thereby forming an apex portion, whereas the other two concave portions 105*a*, 105*b* may be arranged on each side of the concave portion 104 being arranged centred with respect to the longitudinal axis x. The concave portions may, but need not, be arranged at equal distances from each other along the internal surface of the liner. Upon detonation of the explosive, each concave portion will form a separate projectile, wherein each separate projectile collides with the other projectiles, thereby providing a deep and wide penetration hole.

At least one of the concave portions may have a spherical shape. By spherical shape is herein meant a portion of the liner being essential round or spherical in all three dimension. The concave portions of the internal surface may, but need not, have the same shape. In one example, one of the concave portions may form an apex portion, i.e. being centred on the internal surface with respect to the longitudinal axis x. For example, the concave portion being centred at the front portion when viewed in the longitudinal central axis may have a conical shape.

The external surface 102 may be rotational symmetric around the longitudinal central axis x. The internal surface 101 may be rotational symmetric around the longitudinal central axis x. Typically, both the external surface 102 and the internal surface 101 are rotational symmetric around the longitudinal central axis x.

The liner 100 preferably comprises a low-density material in order to provide a low weight liner. The liner 100 may comprise a metal or an alloy having a density of from 1 to 10 g/cm$^3$. By the term "density" is meant hereby meant the average density in case the liner is composed of a mixture of materials. Preferably, the liner the liner comprises magnesium or a magnesium alloy. An example of suitable magnesium alloy is AZ31B which is a wrought magnesium alloy with good room-temperature strength and ductility combined with corrosion resistance and weldability.

A thickness of the liner 100 may be 1.0-3.0 mm, preferably 1.5-2.5 mm, most preferably 1.8-2.3 mm at a thinnest portion of the liner, i.e. where the distance r1, r2 with respect to a center point p of the base plane is largest. As illustrated in FIG. 2, the thinnest portion(s) may be arranged at, or adjacent to, the middle portion of the liner when viewed along the longitudinal central portion. However, it should be noted that the thinnest portion(s) may be arranged at other portions of the internal surface of the liner, depending on where portions being concave in the longitudinal directions are arranged on the internal surface of the liner.

A thickness of the liner 100 may be 8.0-5.5 mm, preferably 7.0-6.0 mm, most preferably 6.0-6.5 mm at a thickest portion of the liner, i.e. where the distance r1, r2 with respect to a center point p of the base plane is smallest. As illustrated in FIG. 2, the thickest portion(s) may be arranged at, or adjacent to, the front portion of the liner 100, i.e. at the portion opposite being to the base end 103. However, it should be noted that the thickest portion(s) may be arranged at other portions of the internal surface of the liner, at other portions of the internal surface of the liner, depending on where the portions being concave in the longitudinal directions are arranged on the internal surface of the liner.

As illustrated in FIG. 2, the thickness of the liner may be thicker at the base end portion as compared to the middle portion of the liner when viewed along the longitudinal central portion.

The proposed liner may be manufactured by for example, milling, 3D printing or moulding. The liner may be mounted to the casing of the shaped charge assembly by means of snap-fitting or welding.

The invention claimed is:

1. A shaped charge assembly comprising a casing and a liner, said liner being a hollow dome forming a hollow space, coaxially arranged around a longitudinal central axis of the shaped charge assembly, wherein the casing and the liner together define a volume comprising an explosive, wherein the liner comprises:

an internal surface facing the hollow space, an external surface facing the volume comprising the explosive, and wherein a tangent of the internal surface and a base plane (y) formed at a base end of the liner, said base plane being perpendicular to the longitudinal central axis (x), forms an angle (α) of at least 100°.

2. The shaped charge assembly according to claim 1, wherein the angle (α) is 100°-120°.

3. The shaped charge assembly according to claim 1, wherein the tangent forming the angle (α) extends along the internal surface at most ⅛ of a total length of the liner along the longitudinal central axis (x).

4. The shaped charge assembly according to claim 1, wherein the internal surface comprises at least three portions facing the hollow space, wherein the internal surface of each portion facing the hollow space is concave in the longitudinal direction of the shaped charge assembly, wherein each concave portion is arranged within a distance (r1, r2) with respect to a center point (p) of the base plane.

5. The shaped charge assembly according to claim 4, wherein at least one of the concave portions has a spherical shape.

6. The shaped charge assembly according to claim 4, wherein at least one of the concave portions forms an apex portion of the internal surface.

7. The shaped charge assembly according to claim 1, wherein the hollow dome has a spheroidal, hemispherical or ellipsoidal shape.

8. The shaped charge assembly according to claim 1, wherein the external surface is rotationally symmetric around the longitudinal central axis (x).

9. The shaped charge assembly according to claim 1, wherein the internal surface is rotationally symmetric around the longitudinal central axis (x).

10. The shaped charge assembly according to claim 1, wherein the liner comprises a metal or an alloy having a density of from 1 to 10 g/cm3.

11. The shaped charge assembly according to claim 10, wherein the liner comprises magnesium.

12. The shaped charge assembly according to claim 1, wherein a thickness of the liner is 1.0-3.0 mm.

13. The shaped charge assembly according to claim 1, wherein a thickness of the liner is 8.0-5.5 mm.

14. The shaped charge assembly according to claim 1, wherein the angle (α) is 102-118°.

15. The shaped charge assembly according to claim 1, wherein the angle (α) is 105-115°.

16. The shaped charge assembly according to claim 1, wherein a thickness of the liner is 1.5-2.5 mm.

17. The shaped charge assembly according to claim 1, wherein a thickness of the liner is 1.8-2.3 mm at a thinnest portion of the liner.

18. The shaped charge assembly according to claim 1, wherein a thickness of the liner is 7.0-6.0 mm.

19. The shaped charge assembly according to claim 1, wherein a thickness of the liner is 6.0-6.5 mm at a thickest portion of the liner.

* * * * *